US006446565B2

(12) United States Patent
Stricker et al.

(10) Patent No.: US 6,446,565 B2
(45) Date of Patent: Sep. 10, 2002

(54) BLAST TUYERE FOR SHAFT FURNACES, IN PARTICULAR BLAST FURNACES OR HOT-BLAST CUPOLA FURNACES

(75) Inventors: Peter Kurt Stricker, Düsseldorf; Jürgen Witte, Rheurdt; Rainer Altland, Meerbusch, all of (DE)

(73) Assignee: Mannesmannröhren-Werke AG, Mülheim/Ruhr (DE)

( * ) Notice: Subject to any disclaimer, the term of this patent is extended or adjusted under 35 U.S.C. 154(b) by 0 days.

(21) Appl. No.: 09/915,948

(22) Filed: Jul. 26, 2001

Related U.S. Application Data

(63) Continuation of application No. PCT/DE00/00216, filed on Jan. 20, 2000.

(30) Foreign Application Priority Data

Feb. 5, 1999 (DE) ..... 199 06 173
Dec. 17, 1999 (DE) ..... 199 63 259

(51) Int. Cl.[7] ..... F23L 5/00; F22B 37/00; C21B 7/16; C21C 5/48

(52) U.S. Cl. ..... 110/182.5; 122/6.6; 266/218; 266/265

(58) Field of Search ..... 122/6.6; 110/182.5; 239/132.3; 165/169; 266/186, 218, 265, 189, 219

(56) References Cited

U.S. PATENT DOCUMENTS 459,470 A * 9/1891 Langdon ..... 110/182.5
2,735,409 A * 12/1952 Aurin et al. ..... 122/6.6
2,891,783 A * 6/1959 Eberhardt ..... 110/6.6
3,061,300 A * 10/1962 Schultz ..... 266/41
3,069,760 A * 12/1962 Schultz ..... 110/6.6
3,572,675 A 3/1971 Maloney
3,601,384 A 8/1971 Durdin
3,826,479 A * 7/1974 Ikegawa ..... 266/41
3,840,219 A * 10/1974 Sheridan et al. ..... 266/41
3,881,710 A * 5/1975 Jupko ..... 266/41
4,166,433 A * 9/1979 Kewin ..... 122/6.6
5,989,488 A * 11/1999 Hori ..... 266/270

FOREIGN PATENT DOCUMENTS

FR 579 150 10/1924
GB 2 245 349 1/1992

OTHER PUBLICATIONS

Patent Abstracts of Japan, vol. 007, No. 225 (C–189).

* cited by examiner

*Primary Examiner*—Ira S. Lazarus
*Assistant Examiner*—K. B. Rinehart
(74) *Attorney, Agent, or Firm*—Henry M. Feiereisen

(57) ABSTRACT

A blast tuyere for shaft furnaces, includes a conical hollow main body having inner and outer casings defining a hollow space and interconnected by a tuyere nose. The outer casing is formed by a single-piece base body terminating smoothly in the tuyere nose, and the inner casing is formed by a conical weld-in part. The hollow space is divided in antechamber, adjacent the tuyere nose, and main chamber, completely separated hydraulically and including separate coolant circuits. The coolant circuit for the antechamber includes two parallel passages for supply and return of coolant. The passages terminate in a ring channel, arranged in the tuyere nose in a direction transversely to the passages, and are located in an area of an upper apex of the main body radially outside the main chamber. The coolant circuit for the main chamber includes a helical cooling passageway whose inner wall is formed by the weld-in part.

11 Claims, 3 Drawing Sheets

BLAST TUYERE FOR SHAFT FURNACES, IN PARTICULAR BLAST FURNACES OR HOT-BLAST CUPOLA FURNACES

CROSS-REFERENCES TO RELATED APPLICATIONS

This application is a continuation of prior filed copending PCT International application no. PCT/DE00/00216, filed Jan. 20, 2000.

This application claims the priorities of German Patent Application Serial No. 199 06 173.4, filed Feb. 5, 1999, and German Patent Application Serial No. 199 63 259.6, filed Dec. 17, 1999, the subject matter of which is incorporated herein by reference.

BACKGROUND OF THE INVENTION

The present invention relates to a blast tuyere for shaft furnaces,in particular blast furnaces or hot-blast cupola furnaces.

A typical blast tuyere (denoted "tuyere" hereinafter) may include an inner casing and an outer casing which are connected to one another by a nose portion. Hot air is fed through the inner casing while a coolant flows through a hollow space between the inner and outer casings during operation. Tuyeres of this type are water-cooled and mainly made from copper or copper alloys for supply of hot air to the inside of the furnace. When used in connection with blast furnaces, the hot blasts may reach temperatures in the range between 700° C. up to more than 1300° C. at pressures between 2.5 and 5.5 bar. Hereby, not only the inner casing of the tuyere and in particular the tuyere nose are exposed to severe stress but increasingly also the casing area through melting phases, such as e.g. pig iron, slag, partially reduced burden materials and zinc, and through abrasion with coke and/or wind, as the refractory lining of the furnace progressively wears off to eventually result in an exposure of the tuyere nose. In order to realize a sufficient service life under such severe strains, any tuyere must be intensely cooled by a circulating coolant, normally cooling water, to maintain acceptable temperatures. Moreover, surface wear of the tuyere as a consequence of corroding effect of the melting phases and abrasion should be minimized.

German Offenlegungsschrift DE-OS 35 05 968 describes a tuyere for shaft furnaces, which includes a double-walled hollow body mounted on a base and having an inner casing and an outer casing interconnected by a nose portion. The hollow space formed between the inner and outer casings is divided into an antechamber and a main chamber by an intermediate wall in the area of nose portion. A feed pipe arranged in the base supplies coolant and extends through the main chamber and the intermediate wall to the antechamber. The intermediate wall has several openings so that coolant can flow back from the antechamber to the main chamber and from there via the openings in the base into a ring chamber which is provided with a return flow connection. This conventional tuyere suffers shortcomings because it uses only one cooling circuit. As consequence, when the cooling system breaks down or leaks occur in the tuyere, the coolant amount tapers off, exposing the tuyere to sever stress, which leads in a short time to a destruction of the tuyere and thus to production losses or in a worst case to accidents. In addition, as the cooling water is not guided at various locations, turbulences occur which promote steam bubbles and this greatly impairs the heat dissipation in these locations. In a worst-case scenario, this may lead to localized melting and thus to a destruction of the tuyere.

U.S. Pat. No. 2,735,409 describes a tuyere in which the hollow body is subdivided into an antechamber in the area of the tuyere nose and a main chamber which is connected to the antechamber, wherein the antechamber and the main chamber are completely hydraulically separated from one another and use separate coolant circuits with their own connections. The coolant circuit of the main chamber includes a tightly wound helical pipe which forms the outer casing, whereas the coolant circuit of the antechamber includes two straight pipes arranged in parallel relationship and terminating in a U-shaped ring channel of the tuyere nose. The inner casing may be formed as smooth conical pipe, with both straight pipes of the antechamber disposed between the inner and outer casings, or also as tightly wound helical pipe. The tuyere nose is made as separate member and connected either via anchors with the rear connection piece or directly via a welding seam with the inner and outer casings. This conventional tuyere suffers shortcomings because the configuration dictates that the cooling channels in the main chamber area are very small and of adverse transverse shape (rectangular), and because the configuration dictates that the feed pipe to the antechamber has very small cross sections. In view of the cross sectional reduction and an increasing deviation from a round cross section, the volume stream of coolant decreases superproportionally in the antechamber as well as in the main chamber, resulting in a significant deterioration of the cooling effect. In addition, the cross section of the cooling channel of the antechamber should also be of similarly small size as the cross section of the cooling channel of the main chamber. Thus, the cross section has a rectangular configuration, resulting in very poor side proportions and thus in a poor cooling effect. It is also disadvantageous that the feed channel terminates in the cooling channel of the antechamber, because it leads to a high hydraulic resistance in this cooling circuit, resulting in a smaller volume flow of coolant and lower coolant speed in the antechamber and thus in a poor cooling effect. The overall construction of the tuyere is also very complicated to manufacture and exhibits many critical sealing areas which can to some degree not be remedied. Also the problem of external attack on the main chamber of the tuyere through drop amounts of hot metal in the blast furnace remains unsolved.

It would therefore be desirable and advantageous to provide an improved blast tuyere, which obviates prior art shortcomings and which realizes an effective cooling action of the tuyere nose while being simple in structure and having a long service life and thus being cost-efficient, without substantially altering available coolant amounts and differential pressures.

It would also be desirable and advantageous to provide an improved blast tuyere, which has a geometric configuration sufficient to protect the tuyere from dripping holt melt in the shaft furnace and to provide an effective cooling action also for the main chamber, without substantially altering available coolant amounts and differential pressures and thus operating costs for cooling water.

SUMMARY OF THE INVENTION

According to one aspect of the present invention, a blast tuyere for shaft furnaces includes a conical hollow main body defining an upper apex and a lower apex, and having an inner casing, an outer casing and a tuyere nose interconnecting the inner and outer casings, with hot air conducted to the shaft furnace through the inner casing, wherein the outer casing is formed by a single-piece base body having a symmetrical cross section with respect to a vertical axis and terminating in the tuyere nose, without formation of a shoulder, wherein the inner casing is formed by a conical weld-in part; wherein the inner and outer casings define a hollow space through which a coolant stream is conducted during operation and which is subdivided in an antechamber, adjacent the tuyere nose, and a main chamber, which are completely separated hydraulically from one another and include separate coolant circuits, wherein the coolant circuit for the antechamber includes two passages of substantially constant cross section, which are arranged in parallel relationship to the longitudinal axis of the main body and representing a supply flow and a return flow, and which are located in an area of the upper apex of the main body outside a cross section of the main chamber as relating to the longitudinal axis and terminate in a ring channel, which is arranged in the tuyere nose in a direction transversely to the passages, wherein the coolant circuit for the main chamber includes a helical cooling passageway of substantially constant cross section, as viewed in length direction of its extension, with the weld-in part forming an inner wall of the helical cooling passageway of the main chamber, and wherein the passages of the coolant circuit for the antechamber for supply and return of coolant are located in an area of the upper apex of the main body outside an original cross section of the main chamber as relating to the longitudinal axis.

The essence of the invention is the formation of the outer casing by a single-piece base body, which is symmetric with respect to the vertical axis, when viewed in cross section, and has a forward end, which terminates in the front portion without shoulders. The inner casing is formed by a conical weld-in part, which forms the inner wall of the helical cooling channel of the main chamber. A further important feature is the arrangement of channels in 12 o'clock position of the blast tuyere that is relating to the longitudinal axis of the blast tuyere, outside the original cross section of the main chamber, for supply of coolant to the front portion. The proposed arrangement of the cooling channels of the antechamber takes into account the different stress of the blast tuyere, as viewed in circumferential direction. Evidently, the blast tuyere is under more severe stress in 12 o'clock position than in the lateral zones. The intense cooling of this stressed zone significantly increases the service life of the blast tuyere. The coolant circuit of the main chamber may selectively be configured as two-threaded helical cooling channel or provided with one helical cooling channel and a straight cooling channel in 6 o'clock position of the blast tuyere. The straight cooling channel in parallel relationship to the longitudinal axis of the blast tuyere and provided without ribs is arranged in relation to the longitudinal axis of the blast tuyere outside the original cross section of the main chamber of the blast tuyere, with the connections for the supply flow and the return flow disposed adjacent to the connections of the antechamber in the area of the 12 o'clock position. The arrangement of the straight cooling channel in 6 o'clock position of the blast tuyere takes into account the different stress of the blast tuyere in circumferential direction. Apart from the 12 o'clock position, the blast tuyere is also under more severe stress in the 6 o'clock position than in the lateral zones. The intense cooling also in this zone further increases the service life of the blast tuyere.

As already mentioned, the present invention provides to move the supply and return channels for the antechamber as well as the return channel of the main chamber away from the area of the original cross section of the main chamber of the blast tuyere, that is radially outside the main chamber, as relating to the longitudinal axis of the blast tuyere. As a consequence, the cooling channel of the main chamber is free of cross sectional restrictions through provision of supply and return channels. Therefore, optimum conditions for enhancing flow dynamics are attained in the main chamber with greatest possible coolant speeds. Moreover, all stated channels have over the length a substantially constant cross section and the required cross sectional changes in the connection zone as well as the directional changes of small radii are rounded and without irregularities.

These measures implement in the main chamber flow rates for the coolant, which are higher by at least twofold as compared to conventional designs. This is accomplished through elimination of dead zones, swirling regions, throttle areas, backup regions as well as optimum design of the cross sectional configurations of the cooling channels (round, trapezoid) and the cross sectional size of the individual channel portions. The optimum design option of the supply and return channel for the antechamber results also in significantly higher flow rates in the antechamber, without changing the differential pressure. If further implementing a balanced ratio of pumping capacity and channel cross-section to realize the intended high flow rates, bubble formation is substantially suppressed hereby. It is also desired to realize a flow rate of $\geqq 10$ m/sec for the cooling of the highly stressed antechamber and $\geqq 6$ m/sec for the main chamber, when lower differential pressure of, for example, 2 bar is available. The proposed configuration of the blast tuyere is suitable for antechambers with only one ring channel as well as for longer antechambers with a helical channel.

As already mentioned above, the blast tuyere is, however, under stress not only purely thermally, but also additionally chemically and mechanically; in particular when the refractory lining of the shaft furnace is worn-off to a certain degree. Hereby, it is proposed to configure the cross section of the blast tuyere in the area of the 12 o'clock position in a roof-shaped manner. This is advantageous because material falling or dripping on the blast tuyere can slide off or drain easier. This configuration should decrease in particular the undesired contacting of liquid zinc, pig iron or slag with the blast tuyere made of copper or copper alloy. As it is known, zinc reacts with copper so that the copper wall diminishes through chemical degradation.

BRIEF DESCRIPTION OF THE DRAWING

Other features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
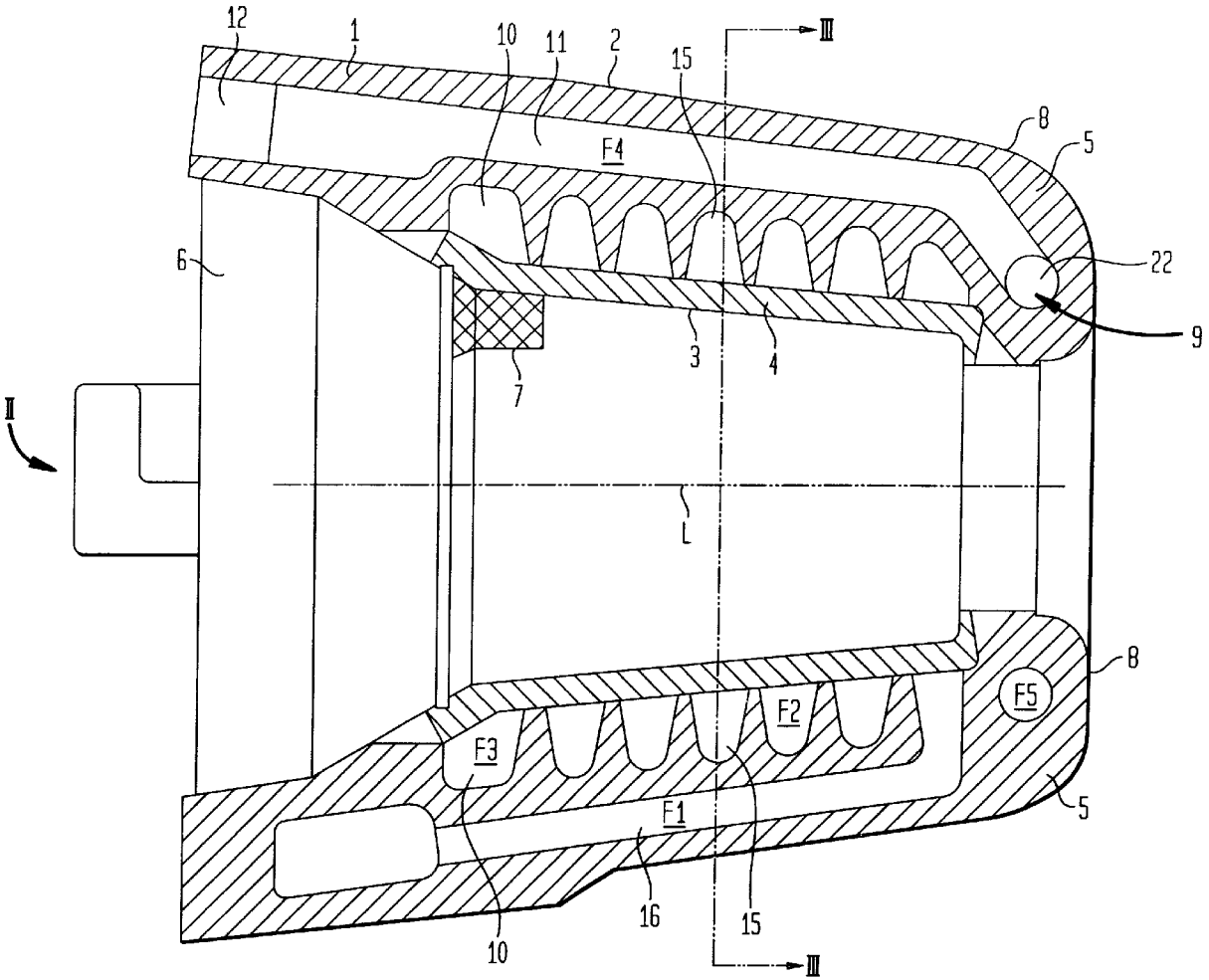
FIG. 1 is a longitudinal section of a tuyere according to the invention, taken along the line I—I in FIG. 2.

Throughout all the Figures, same or corresponding elements are generally indicated by same reference numerals.

Figure 2:
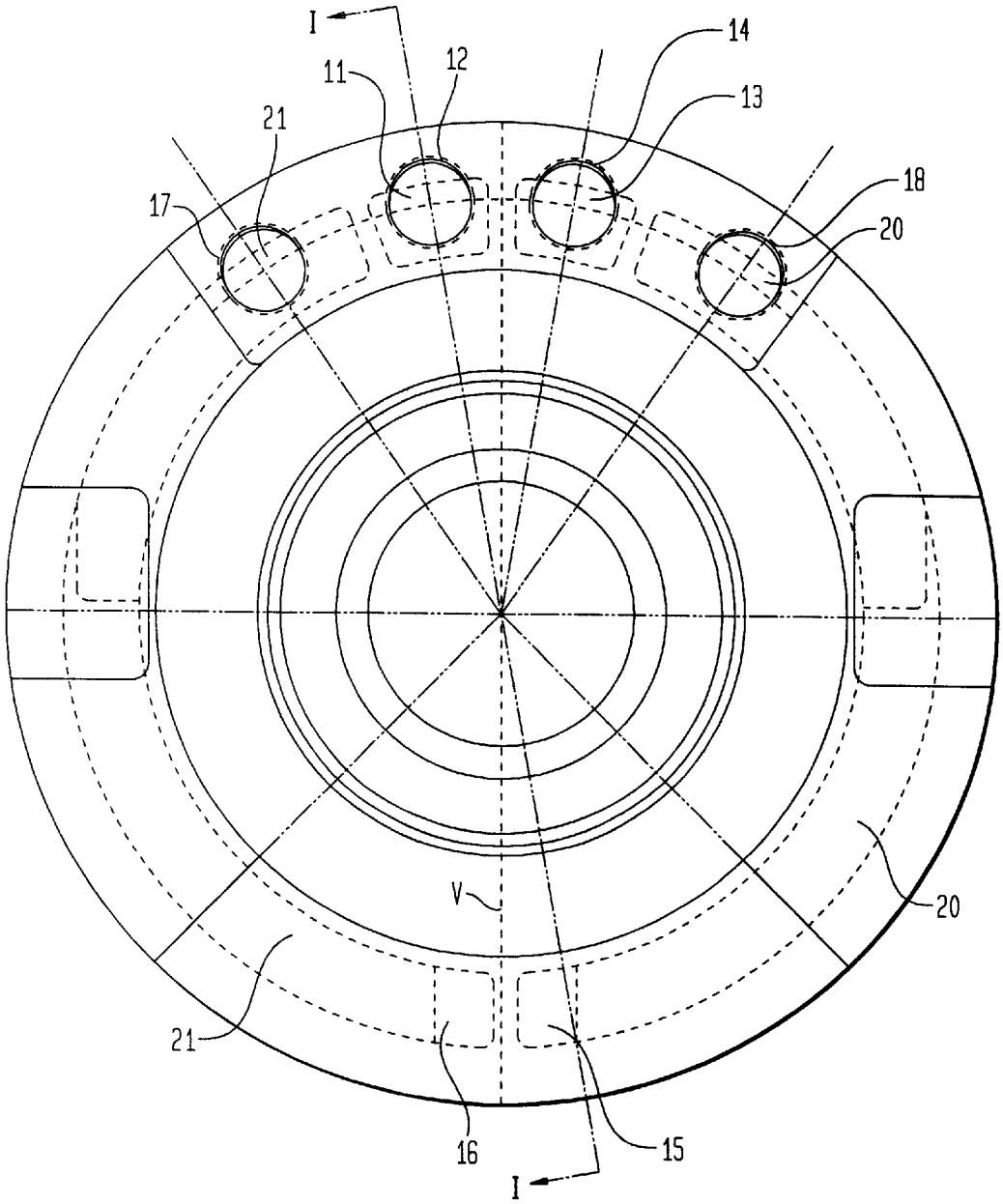
FIG. 2 is a side view of the tuyere in the direction 11 in FIG. 1.
Figure 3:
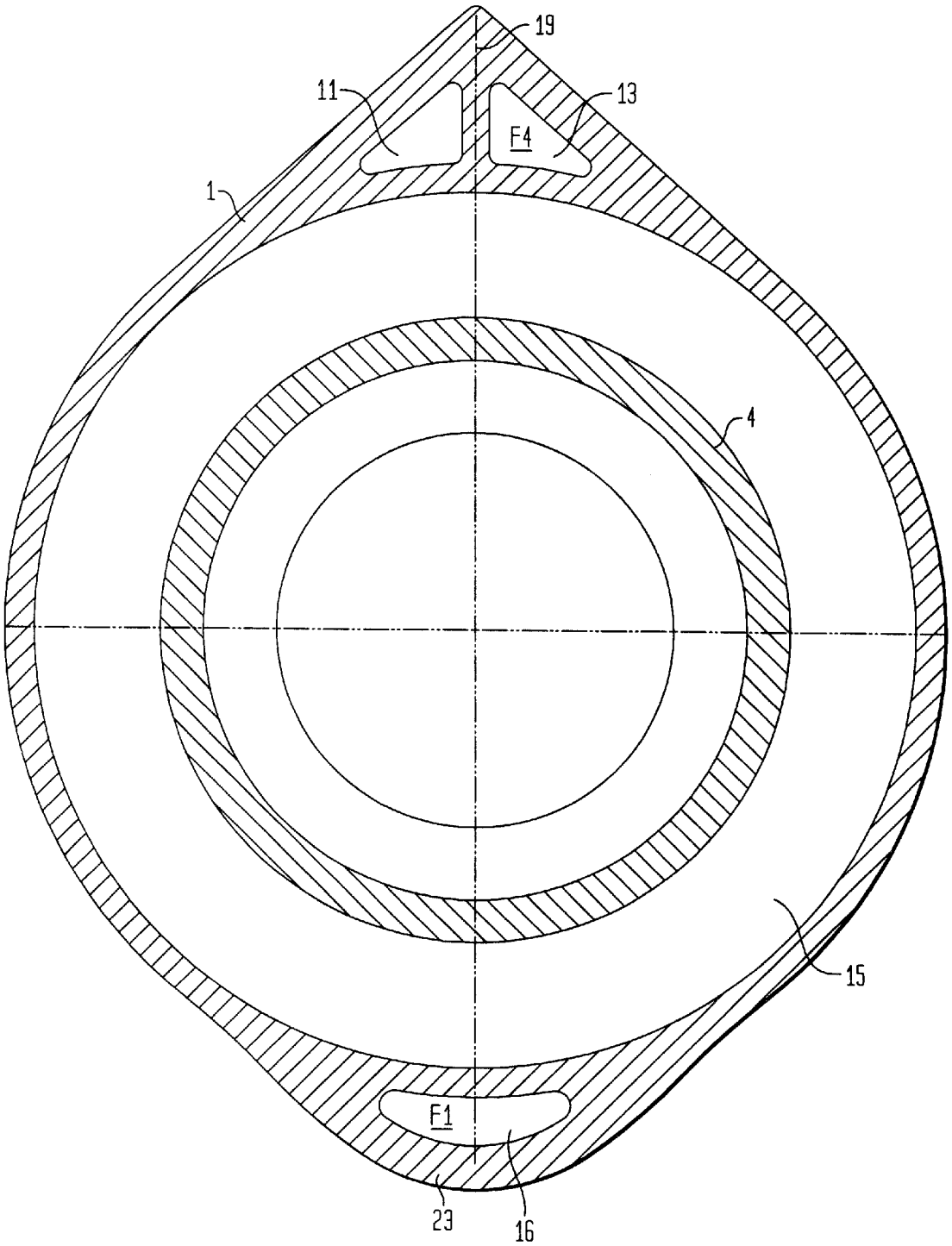
FIG. 3 is a sectional view of the tuyere, taken along the line III—III in FIG. 1.

Turning now to the drawing, and in particular to FIG. 1, there is shown a longitudinal section of a tuyere according to the invention, including a base body 1, which forms an outer casing 2 and has a single-piece configuration which is symmetrical with respect to a vertical axis V, when viewed in cross sectional illustration, compare FIGS. 2 and 3. Welded interiorly to the base body 1 is a conical member 4, which forms an inner casing 3. The base body 1 has a smooth outside surface and ends, without formation of a steps or shoulder, in a tuyere nose 5, which is subject to severe stress during operation. At its nose-distal entry side, the base body 1 has a double-cone inlet portion 6 for insertion of a nozzle tip of a blast connection, not shown. Applied on the inside of the conical member 4 is a refractor lining 7, indicated only schematically. The base body 1 is further reinforced in the area of the tuyere nose 5 a cladding 8 for protection against mechanical damage and wear.

The base body 1 is subdivided in an antechamber 9, arranged in the tuyere nose 5, and a main chamber 10, whereby both the antechamber 9 and the main chamber 10 are completely separated hydraulically from one another and connected to separate cooling circuits for circulation of coolant. The cooling circuit for the antechamber 9 includes a supply channel 11, which, as shown in FIG. 2, is located in the area of the upper apex of the base body I and extends from a nose-distal entry side to the antechamber 9.

In the following description, the term "upper apex" will denote a location or proximity with respect to those portions of the base body 1 which appear on top of FIGS. 2 and 3, commensurate with a 12 o'clock position, while the term "lower apex" will denote the opposite location, commensurate with a 6 o'clock position.

On its entry side, the supply channel 11 is provided with a connection 12 in the form of a threaded section for threaded engagement of a feed pipe, not shown. The supply channel 11 terminates in the antechamber 9, which is formed by a ring channel 22 extending transversely to the supply channel 11. Of course, this configuration is shown by way of example only, and other configurations, which generally follow the concepts outlined here, are considered to be covered by this disclosure. For example, the antechamber 9 may also be configured in the form of a helical channel having several turns.

As shown in FIG. 2, the coolant circuit for the antechamber 9 further includes a return channel 13, which is also arranged in the area of the upper apex of the base body 1 and extends in parallel relationship to the supply channel 11. The return channel 13 is provided with a connection 14 in the form of a threaded section for threaded engagement of a drainpipe, not shown. The positional relationship between the channels 11, 13 is also shown in FIG. 3.

In order to circulate coolant also in the main chamber 10 in an efficient fluidic manner, the coolant circuit for the main chamber 10 includes a helical cooling channel 15, which is integrated in the base body 1 and forms the actual main chamber 1 0, whereby the conical member 4 forms the inside wall of the cooling channel 15, and a straight cooling channel 16 which is formed within the base body 1 outside the main chamber 10 with respect to the longitudinal axis L of the base body 1. The helical cooling channel 15 includes a threaded connection 17 at the nose-distal end for threaded engagement of a drainpipe, not shown, and the straight cooling channel 6 includes a threaded connection 18 at the nose-distal end for threaded engagement of a supply pipe.

As shown in FIG. 2, the connections 17, 18 for supply and drainage of coolant to the cooling channels 15, 16 in the main chamber 10 are positioned in the area of the 11 o'clock and 1 o'clock positions, respectively, adjacent to the connections 12, 14 for the antechamber 9. As viewed in clockwise direction, coolant is routed behind the connection 18, arranged in the 1 o'clock position, through a semi-circular channel 20 (shown in FIG. 2 by broken lines on the right-hand side) in the double-cone inlet portion 6 downwards into the 6 o'clock position to enter the helical cooling channel 15. After streaming through the helical cooling channel 15, the coolant enters directly in front of the antechamber 9 into the cooling channel 16, also arranged in 6 o'clock position and located beneath the helical cooling channel 15, for returning the coolant to the double-cone inlet portion 6. In the double-cone inlet portion 6, the coolant is routed via a semi-circular channel 21 (shown in FIG. 2 by broken lines on the left-hand side) upwardly to the 11 o'clock position until reaching the drain connection 17.

Of course, to achieve the desired intense cooling action, it is immaterial which of the connections 12, 14 for the antechamber 9 is used for supply and which is used for drainage. Likewise, it is immaterial which of the connections 17, 18 for the main chamber 10 is used for supply and which is used for drainage.

The cooling channels 11, 13 for the antechamber 9 are defined by a cross section F4 and the ring channel 22, which forms the antechamber 9, is defined by a cross section F5, whereby F4 substantially corresponds to F5. On the other hand, the cross section F4 of the cooling channels 11, 13 and the cross section F5 of the ring channel 22 are smaller than a cross section F1 of the cooling channel 16 and a cross section F2 of the cooling channel 15 of the main chamber 10 by up to 35%. Thus, the following applies:

$$F4=F5<F1=F2.$$

F3 denotes a cross sectional transition zone from the channel 20 into the cooling channel 15. Suitably, any cross sectional transition zones as well as any small radii directional changes of the channels are substantially rounded so as to prevent swirling zones or dead zones.

The further experienced additional chemical and mechanical stresses of the blast tuyere are greatly influenced by the geometric configuration. The base body 1 is conically tapered in the direction of the shaft furnace, whereby half a cone angle in the range of 12–14° has proven beneficial. Suitably, the upper apex of the main body 1 is configured as a pointed end 19 so that material that may fall or drip from the shaft furnace onto the blast tuyere can easily slide off or drain sideways towards the center of the shaft furnace. In the area of the lower apex, the main body has a bulbed end 23.

While the invention has been illustrated and described as embodied in a blast tuyere for shaft furnaces, in particular blast furnaces or hot-blast cupola furnaces, it is not intended to be limited to the details shown since various modifications and structural changes may be made without departing in any way from the spirit of the present invention.

What is claimed is:

1. A blast tuyere for shaft furnaces, comprising:

a conical hollow main body defined by a longitudinal axis and defining an upper apex and a lower apex, said main body having an inner casing, an outer casing, and a tuyere nose interconnecting the inner and outer casings, with hot air conducted to the shaft furnace through the inner casing, wherein the outer casing is formed by a single-piece base body having a vertically axially symmetrical cross section and terminating smoothly in the tuyere nose, wherein the inner casing is formed by a conical weld-in part;

wherein the inner and outer casings define a hollow space through which a coolant stream is conducted during operation, said hollow space divided in an antechamber, adjacent the tuyere nose, and a main chamber, which are completely separated hydraulically from one another and include separate coolant circuits, wherein the coolant circuit for the antechamber includes two passages of substantially constant cross section, said passages arranged in parallel relationship to the longitudinal axis for supply and return flow of coolant, said passages located in an area of the upper apex of the main body outside a cross section of the main chamber as relating to the longitudinal axis and terminating in a ring channel, which is arranged in the tuyere nose in a direction transversely to the passages, and wherein the coolant circuit for the main chamber includes a helical cooling passageway of substantially constant cross section, as viewed in length direction of an extension of the helical cooling passageway, with the weld-in part forming an inner wall of the helical cooling passageway of the main chamber, wherein the helical cooling passageway of the main chamber has a two-threaded configuration to define a first cooling channel provided for supply of coolant, and a second cooling channel provided for return of coolant, and a 180° bend for interconnecting the first and second cooling channels.

2. A blast tuyere for shaft furnaces, comprising:

a conical hollow main body defined by a longitudinal axis and defining an upper apex and a lower apex, said main body having an inner casing, an outer casing, and a tuyere nose interconnecting the inner and outer casings, with hot air conducted to the shaft furnace through the inner casing, wherein the outer casing is formed by a single-piece base body having a vertically axially symmetrical cross section and terminating smoothly in the tuyere nose, wherein the inner casing is formed by a conical weld-in part;

wherein the inner and outer casings define a hollow space through which a coolant stream is conducted during operation, said hollow space divided in an antechamber, adjacent the tuyere nose, and a main chamber, which are completely separated hydraulically from one another and include separate coolant circuits, wherein the coolant circuit for the antechamber includes two passages of substantially constant cross section, said passages arranged in parallel relationship to the longitudinal axis for supply and return flow of coolant, said passages located in an area of the upper apex of the main body outside a cross section of the main chamber as relating to the longitudinal axis and terminating in a ring channel, which is arranged in the tuyere nose in a direction transversely to the passages, and wherein the coolant circuit for the main chamber includes a helical cooling passageway of substantially constant cross section, as viewed in length direction of an extension of the helical cooling passageway, with the weld-in part forming an inner wall of the helical cooling passageway of the main chamber, wherein the coolant circuit of the main chamber has a straight cooling channel which is free of ribs and arranged in parallel relationship to the longitudinal axis in an area of the lower apex outside the cross section of the main chamber, said straight cooling channel having a first port for supply of coolant and a second port for return of coolant, said first and second ports of the straight cooling channel being located in an area of the upper apex in neighboring relationship to ports for the passages.

3. The tuyere of claim 2, wherein the straight cooling channel has a circular cross section, and the helical cooling passageway of the main chamber has a substantially trapezoidal cross section with rounded corners.

4. The tuyere of claim 2, wherein the passages and the straight cooling channel of the antechamber and the helical cooling passageway of the main chamber have cross sectional changes in a connection zone and directional changes of small radii, said cross sectional changes and said directional changes being rounded and free of irregularities.

5. The tuyere of claim 2, wherein the main body has a double-cone inlet portion which includes two semi-circular channels connected to the first and second ports of the straight cooling channel and extending to an area of the lower apex, said semi-circular channels being completely separated from one another in the area of the upper apex and the lower apex and fluidly connected to the helical cooling passageway of the main chamber, wherein the helical cooling passageway of the main chamber has a forward end terminating directly at a partition wall to the antechamber in the straight cooling channel which is located underneath the helical cooling passageway and ends in the double-cone inlet portion.

6. The tuyere of claim 2, wherein the passages of the antechamber have a cross section which substantially corresponds to a cross section of the ring channel in the antechamber and is smaller than cross sections of the helical cooling passageway and the straight cooling channel of the main chamber.

7. The tuyere of claim 2, wherein the straight cooling channel of the main chamber has a cross section, which substantially corresponds to a cross section of the helical cooling passageway of the main chamber.

8. The tuyere of claim 6, wherein the cross sections of the passages and the ring channel of the antechamber are smaller by up to 35% than the cross sections of the helical cooling passageway and the straight cooling channel of the main chamber.

9. The tuyere of claim 6, wherein a flow rate of coolant in the helical cooling passageway and the straight cooling channel of the main chamber is at least 60% of a flow rate of coolant in the passages and the ring channel of the antechamber, when a substantially same pumping capacity is provided for coolant supply through the coolant circuit for the antechamber and the coolant circuit for the main chamber.

10. The tuyere of claim 9, wherein the flow rate of coolant in the passages and the ring channel of the antechamber is at least 10 m/sec, and the flow rate of coolant in the helical cooling passageway and the straight cooling channel of the main chamber is at least 6 m/sec, at a coolant differential pressure of 2 bar.

11. The tuyere of claim 2, wherein the main body has a pointed end in the area of the upper apex and a bulbed end in the area of the lower apex, wherein the passages of the antechamber are disposed in the area of the pointed end, and the straight cooling channel of the main chamber is disposed in the are of the bulbed end.

* * * * *